US006678920B2

(12) United States Patent
Parker et al.

(10) Patent No.: US 6,678,920 B2
(45) Date of Patent: Jan. 20, 2004

(54) SOFT-TOUCH DRAWER PULL

(75) Inventors: Brian G. Parker, Alto, MI (US); Cameron Courtwright, Centerville, IA (US); Dean T. Miller, Wyoming, MI (US)

(73) Assignee: Cascade Engineering, Inc., Grand Rapids, MI (US)

( * ) Notice: Subject to any disclaimer, the term of this patent is extended or adjusted under 35 U.S.C. 154(b) by 0 days.

(21) Appl. No.: 10/178,175

(22) Filed: Jun. 24, 2002

(65) Prior Publication Data

US 2003/0233733 A1 Dec. 25, 2003

(51) Int. Cl.[7] ..... A47B 95/02

(52) U.S. Cl. ..... 16/415; 16/111.1; 16/425; 16/436; 16/DIG. 19; 312/348.6

(58) Field of Search ..... 16/415, 421, 111.1, 16/425, 436, 443, 444, 446, DIG. 12, DIG. 19; 312/244, 348.4, 348.6

(56) References Cited

U.S. PATENT DOCUMENTS 2,654,115 A * 10/1953 Kafer ..... 16/421
2,803,849 A * 8/1957 Peters ..... 16/421
4,379,603 A * 4/1983 Johnson et al. ..... 16/416
4,416,166 A * 11/1983 Jannard et al. ..... 16/421
5,145,082 A * 9/1992 Craft et al. ..... 16/421
5,299,475 A * 4/1994 Stroop ..... 16/421
5,475,896 A * 12/1995 Wang ..... 16/421
5,581,845 A * 12/1996 Yang ..... 16/421
5,771,536 A * 6/1998 Sieg et al. ..... 16/431
6,363,578 B1 * 4/2002 Chang ..... 16/430

* cited by examiner

*Primary Examiner*—Anthony Knight
*Assistant Examiner*—Christopher V. Boswell
(74) *Attorney, Agent, or Firm*—Warner Norcross & Judd LLP

(57) ABSTRACT

A soft-touch drawer pull including a substantially rigid substrate and a rubber-like plastic attached to the outer surface of the substrate. The substrate preferably includes teeth or catches on an inner surface that interact with corresponding recesses or holes on a drawer unit or other article to allow the drawer pull to be easily secured to the unit or article. Preferably, the drawer pull further includes catches that interact with snaps on a drawer to further secure the drawer pull to the drawer.

12 Claims, 5 Drawing Sheets

SOFT-TOUCH DRAWER PULL

BACKGROUND OF INVENTION

The present invention relates to furniture and, more specifically, to handles for drawers.

Many articles of furniture include drawers to provide storage space. Desks, tables and cabinets typically include one or more drawers to store or conceal items and provide easy access to those items. Often, the storage space required by a user cannot be satisfied by conventional furniture, for example, desks or tables. Accordingly, a drawer pedestal including one or more drawers is used to increase the storage space. Conventional drawer pedestals are constructed either to stand alone or be positioned under a desk, table or similar furniture.

Most furniture and associated drawers are constructed from wood or metal, and fastened together with screws or bolts. Accordingly, the furniture and drawers typically are quite heavy. This makes shipping expensive and movement of the pedestals by an end user relatively difficult. Moreover, when furniture components are disassembled, they are not readily stackable because the components are constructed from rigid wood or metal, which makes handling and storage of the disassembled components space-consuming.

Recently, furniture is being constructed from plastic because of its lightweight. In many cases, its strength is similar to that of wood or metal. Some consumers, however, believe that plastic furniture looks and feels "cheap," and thus are unwilling to purchase and use it. For example, when physically tapped on by a user, most plastic units create a hollow, resounding thud, which makes the unit sound structurally inadequate. Additionally, drawers of plastic furniture units, which also are constructed of plastic, add to the unappealing feel of plastic furniture. Specifically, most plastic drawers are a single molded part, and to decrease production costs, include an integral drawer pull which is typically an indent in the front panel of the drawer that a user may grasp. Thus, the handle is made of the same plastic as the remainder of the unit. Because many users associate the feel of plastic with inexpensive and poor quality items, these integral plastic handles have a substantially negative impact on many users' satisfaction with plastic furniture pieces.

Several attempts have been made to increase the aesthetic feel of the handles of drawers. However, all the attempts are time consuming and require additional processing of a drawer. In one process, an adhesive-backed rubber material is applied to the handle of a finished drawer. This material, however, is quite thin and, therefore, difficult to permanently secure to the finished unit. Misalignment, wrinkling and tearing of the material commonly complicates its attachment to drawers. In another process, a liquid rubber-like compound is applied to the integral drawer handle to increase the feel and gripability of the handle. After time, however, the material tends to delaminate from the drawer unit, resulting in an aesthetically unappealing, frayed or torn drawer handle cover. In another process, a second plastic material is molded over a portion of an already-formed plastic drawer to form the handle. This method is problematic, especially where the drawers are large or include multiple internal compartments, because a large complex mold must be used to injection mold the rubber-like material onto the formed drawer.

Thus, many opportunities exist to provide a drawer that includes an inexpensive and easily attached drawer pull that is aesthetically pleasing and/or soft to the touch.

SUMMARY OF THE INVENTION

The aforementioned problems are overcome by the present invention wherein a drawer pull is provided that easily and securely attaches to a drawer. Preferably, the drawer pull includes a "soft-touch" material that significantly improves the aesthetics and feel of the drawer pull.

In a preferred embodiment, the drawer pull includes a plastic substrate and a softer material that is secured to the substrate via molding or adhesive. The softer material is a soft, rubber-like material. In a more preferred embodiment, the substrate defines a channel and includes one or more locking tabs that project into the channel. The locking tabs may project from opposite sides of the channel toward one another.

In an even more preferred embodiment, the drawer to which the drawer pull is secured includes recesses or slots or holes adapted to receive the locking tabs so that the pull interlocks with the drawer. Where the drawer pull includes opposing locking tabs in the channel, the drawer may also include recesses to engage the opposing locking tabs to enhance the interlock of the drawer pull to the drawer.

The drawer pull of the present invention offers many benefits. The pull is easy to manufacture and install. The pull may be manufactured with a two-shot injection process where the rigid substrate and soft material are molded to one another in a relatively small mold. The its interlocking tabs, the pull may easily be snapped onto the drawer, making installation of the drawer-pull a simple step in assembly. Furthermore, different pulls may be colored differently and installed on drawers to the custom order of the end user.

These and other objects, advantages, and features of the invention will be readily understood and appreciated by reference to the detailed description of the invention and the drawings.

DETAILED DESCRIPTION OF THE INVENTION

Figure 1:
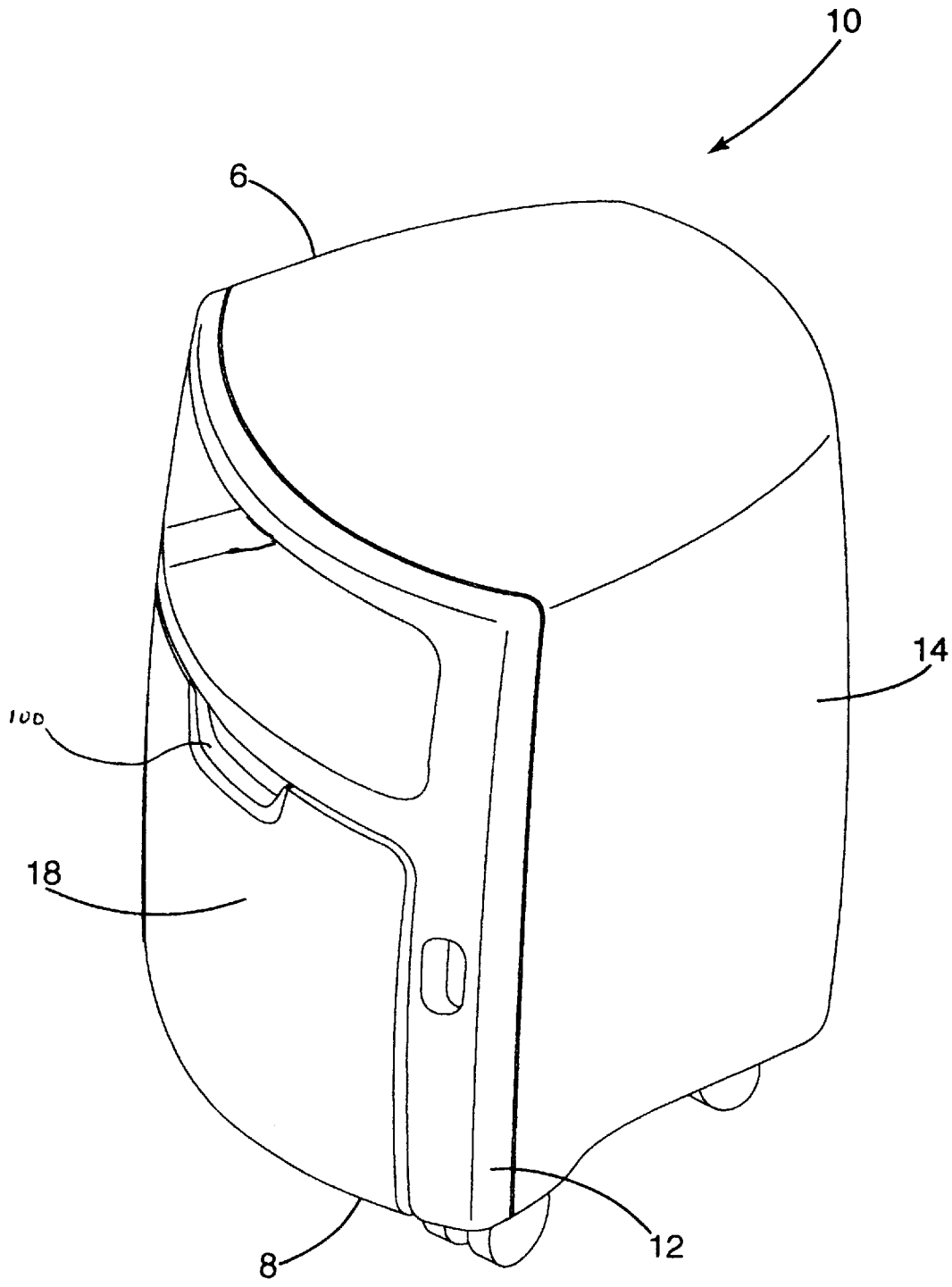
FIG. 1 is a perspective view of a drawer pedestal including a handle according to a preferred embodiment of the present invention.

A handle 100 and related drawer assembly 18 in accordance with a preferred embodiment of the present invention is shown generally in FIG. 1 in conjunction with a drawer pedestal 10. The pedestal 10 generally includes a top 6, a bottom 8, a substructure 12, a shell 14, and a drawer assembly 18. A drawer assembly 18 is interfit within the assembled drawer pedestal. The handle 100 is secured to the drawer assembly 18. Although the present invention is described here in relation to a handle secured to a drawer of a drawer pedestal, the handle is well-suited for use with essentially any type of furniture component of any type of furniture of any shape. Moreover, the handle of the present invention may be used in a variety of other products, for example automotive trim, appliances, construction materials and the like.

I. Construction

The components of the drawer assembly 18 and handle 100 are described in greater detail with reference to FIGS. 2–7. In the preferred embodiment, the drawer assembly components are constructed from injection molded plastic, however other plastics, metal, wood or materials may be used as desired. Additionally, each drawer assembly component preferably is constructed as an integral piece, however, each component may be constructed from one or more separate parts as desired.

A. Drawer

Figure 2:
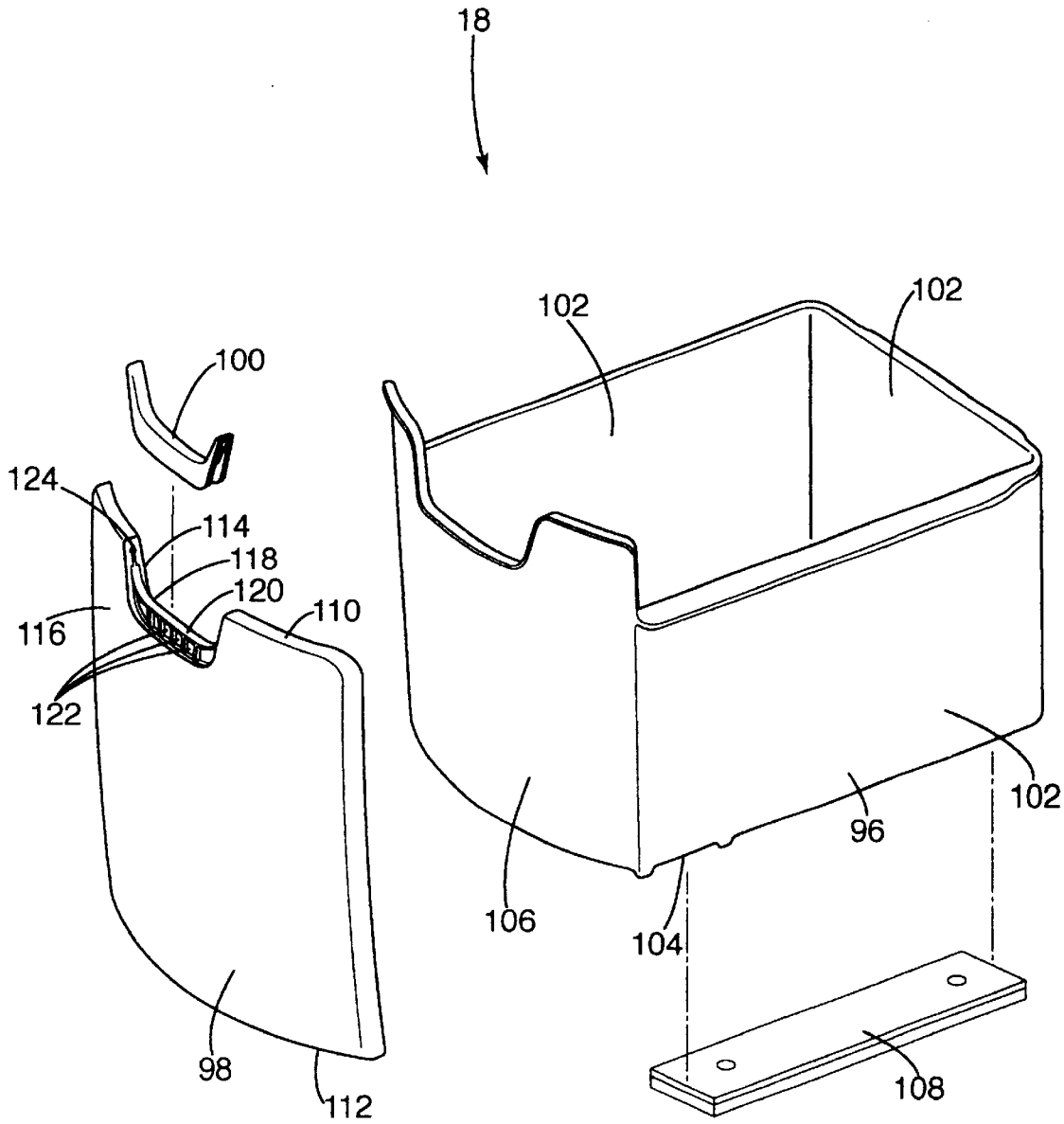
FIG. 2 is an exploded view of a drawer unit.
Figure 6:
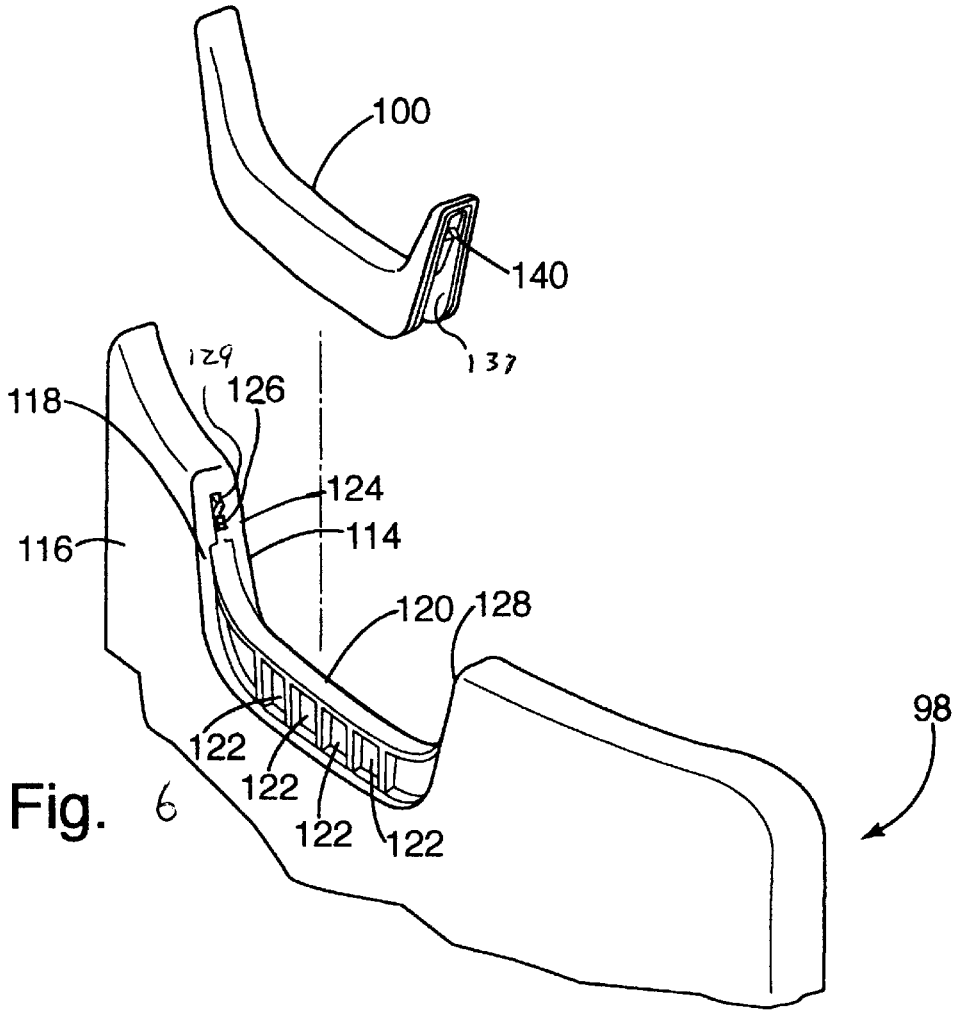
FIG. 6 is an exploded perspective view of the handle and the drawer.
Figure 7:
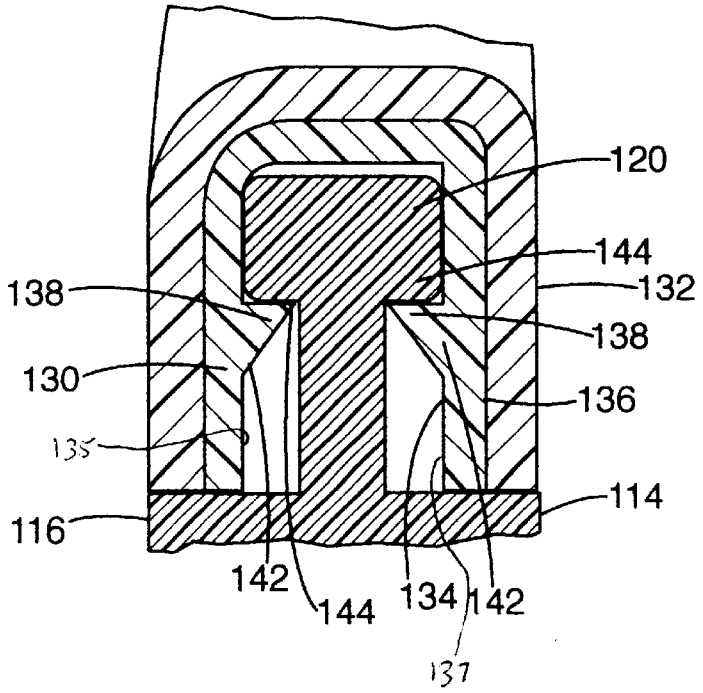
FIG. 7 is a cross-sectional view of the handle secured to the drawer.

Referring to FIGS. 2, 6 and 7, a drawer assembly 18 is depicted including a drawer 96, front drawer panel 98 and handle 100. The drawer 96 is generally rectangular and includes drawer side walls 102, a drawer bottom wall 104 and a drawer front wall 106.

The front drawer panel 98 includes a top panel end 110 and a bottom panel end 112, and an internal panel side 114 and an external panel side 116. The internal panel side 114 of the front drawer panel 98 is attached to the drawer front wall 106 of the drawer 96. The front drawer panel 98 may be attached to the drawer 96 by any conventional means. The front drawer panel 98 defines a panel recess 118 along the top panel end 110. Optionally, the front drawer panel 98 may form the front wall of the drawer 96 and the front drawer wall 106 may be absent.

In the embodiment of FIG. 6, a rib 120 protrudes from the panel recess 118. The rib 120 includes a number of rib recesses 122, which add strength to the rib 120. The rib recesses 122 preferably are substantially rectangularly shaped indents spaced along the rib 120, and may be located on both the internal panel side 114 and the external panel side 116. Any number of recesses may be used as desired. In one embodiment, there are at least two rib recesses 122 located on each of the internal panel side 114 and external panel side 116 of the rib 120.

With further reference to FIG. 6, the front drawer panel 98 includes snaps 126 preferably located on both the left recess side 127 and right recess side 128 of the panel recess 118. Each snap 126 generally includes either a tab 129 or a hole or recess 127, defined by the front panel 98, or both the tab 129 and hole or recess 127. The holes and tabs may be of any shape or size, but preferably the tab and the hole are of complimentary shape and size to receive and hold catch 140 of handle 100. The snaps 126 are located on each of the left recess side 124 and right recess side 128 of the front drawer panel 98 above the rib 120. Preferably, the snaps 126 do not compromise the strength of rib 120. Optionally, the bottom edge of the hole or recess 127 of each snap 126 is adjacent the rib 120. And optionally, any number of snaps 126 may be used. The snaps 126 may be located in the top half of each of the left recess side 124 and right recess side 128 of the panel recess 118.

In one embodiment, each tab 129 is a substantially triangular protrusion extending from the left recess side 124 and right recess side 128. Each tab 129 forms the top edge of the respective snap 124. The tabs 129 further interlock with the catch 140 of the handle 100 to secure the handle 100 to the front drawer panel 98 after placement of the handle 100 on the rib 120.

B. Handle

Figure 3:
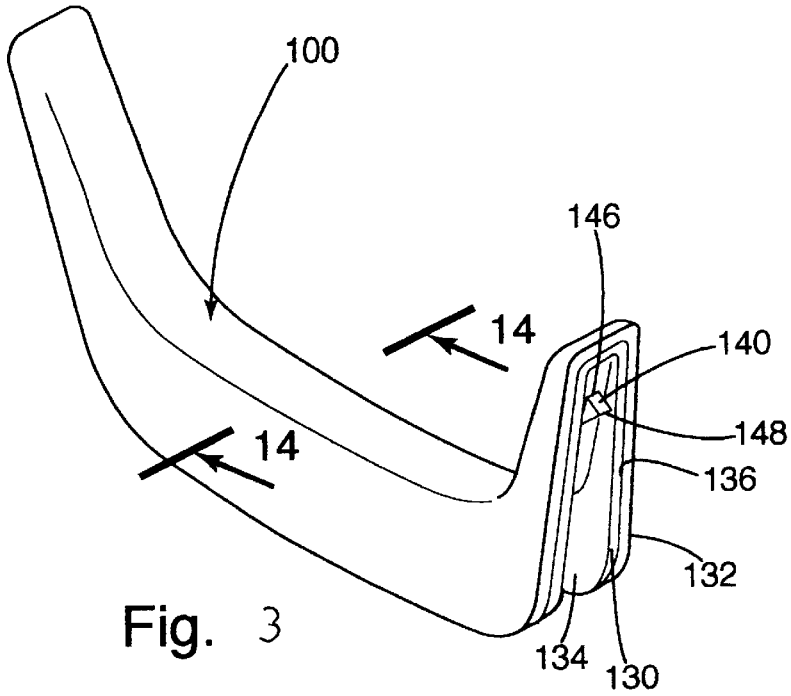
FIG. 3 is a perspective view of a handle of the drawer unit.
Figure 4:
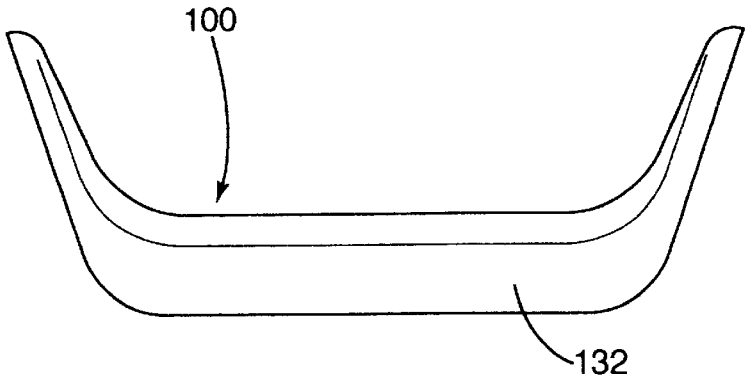
FIG. 4 is a front elevational view of the handle.
Figure 5:
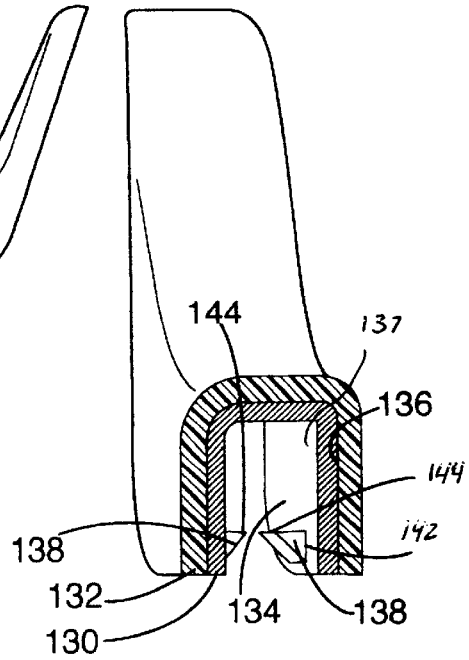
FIG. 5 is a cross-sectional view of the handle taken along line 14—14.

With reference to FIGS. 3–5, the handle 100 includes a substrate 130 and a material 132 secured to the substrate. Preferably, the substrate 130 is made from a substantially rigid material, for example, a plastic, such as high-density polyethylene, polypropylene, nylon, polyvinyl chloride, polyethylene terepthalate, polycarbonate and any combination of the foregoing. Optionally, any other material may be used as desired. The substrate 130 includes a substrate inner surface 134 and a substrate outer surface 136. The substrate 130 defines a channel or slot 150 therein configured to interlock over the rib 120 when the handle 100 is installed on the panel 98. As shown, the channel is of a substantially U-shaped cross section, however, other cross sections may be used as desired. Moreover, although the channel extends across substantially the entire width of the handle 100, it may be segmented to extend across only portions of the pull.

Referring to FIGS. 5 and 7, the substrate 130 preferably includes teeth 138 projecting inwardly into the channel. Each tooth 138 has a base 142 and a tip 144. The base 142 of each tooth 138 is attached to the substrate inner surface 134 so that when the substrate 130 is placed over the rib 120, the tip 144 of each tooth 138 interlocks with a rib recess 122. This interlock secures the handle 100 to the panel 98. Optionally, the teeth 138 and rib recesses 122 may be replaced with one another as desired. For example, the teeth may be associated with the rib 120 and corresponding recesses may be associated with the substrate 130. In one embodiment, two teeth 138 are located on each of the left inner side 135 and right inner side 137 of the channel 150. More or less teeth may be included as desired.

Optionally, catches 140 are located on the substrate inner surface 134. Each catch includes a catch base 146 and a catch tip 148. The catch base 146 of each catch 140 is attached to the substrate inner surface 134 of the substrate 130 so that, when the substrate 130 is placed over the rib 120, the catch tip 148 of each catch 140 interlocks with d snap 124 on the front drawer panel 98. The tabs 129 help ensure a tight, interlocking fit between the catches 140 and the snaps 124 to prevent the handle 100 from becoming dislodged from the drawer panel 98 during use. The front drawer panel 98 includes at least as many snaps 124 as there are catches 140 on the substrate 130. Optionally, the snaps and catches may be absent from the drawer panel and the handle as desired.

The material 132 is attached to substantially all of the substrate outer surface 136. The material 132 is preferably a low-density, textured plastic but may be made of any material capable of being attached to the substrate 130, for example, polyvinyl chloride (PVC), thermoplastic rubber (TPR), thermoplastic urethane (TPU), thermoplastic polyurethane (TPE), and thermoplastic polyolefins (TPOs). Any material that improves the feel, look and/or gripability of the handle 100 may be used as desired.

In one embodiment, the material 132 is injection molded to the substrate outer surface 136 in a two-shot molding process. Optionally, the material may be molded to the substrate 130 after the substrate is formed, or adhered to the substrate with a suitable adhesive. Additionally, the color of the material 132 may vary. This allows the end-user or manufacturer to choose the desired handle color before attachment of the handle 100 to the drawer assembly II. Assembly To secure the handle 100 to the front panel 98, a user or a robot in an automated process, grasps the handle 100 and aligns the channel 150 with the rib 120, and the handle 100 with the panel recess 118. The user presses the handle 100 downward onto the front panel 98. As the teeth 138 engage the rib 120, the user continues to press forcibly downward so that the channel 150 opens up slightly. The angle of the faces of the teeth 138 and the rounded corners of the rib 120 assist in opening the channel. The handle 100 is continued to be pushed forcibly downward until the teeth pass the rib 120 and the channel snaps closed, pressing the teeth into the rib recesses 122 thereby interlocking the handle 100 to the drawer. Additionally, the catches 140 pass over the tabs 129 and interfit into the holes or recesses 127 to further interlock the upper portion of the handle 100 into the panel recess 118. The handle 100 may be assembled in a production line or by the end user after delivery of the unit.

III. Alternative Embodiment

Figure 8:
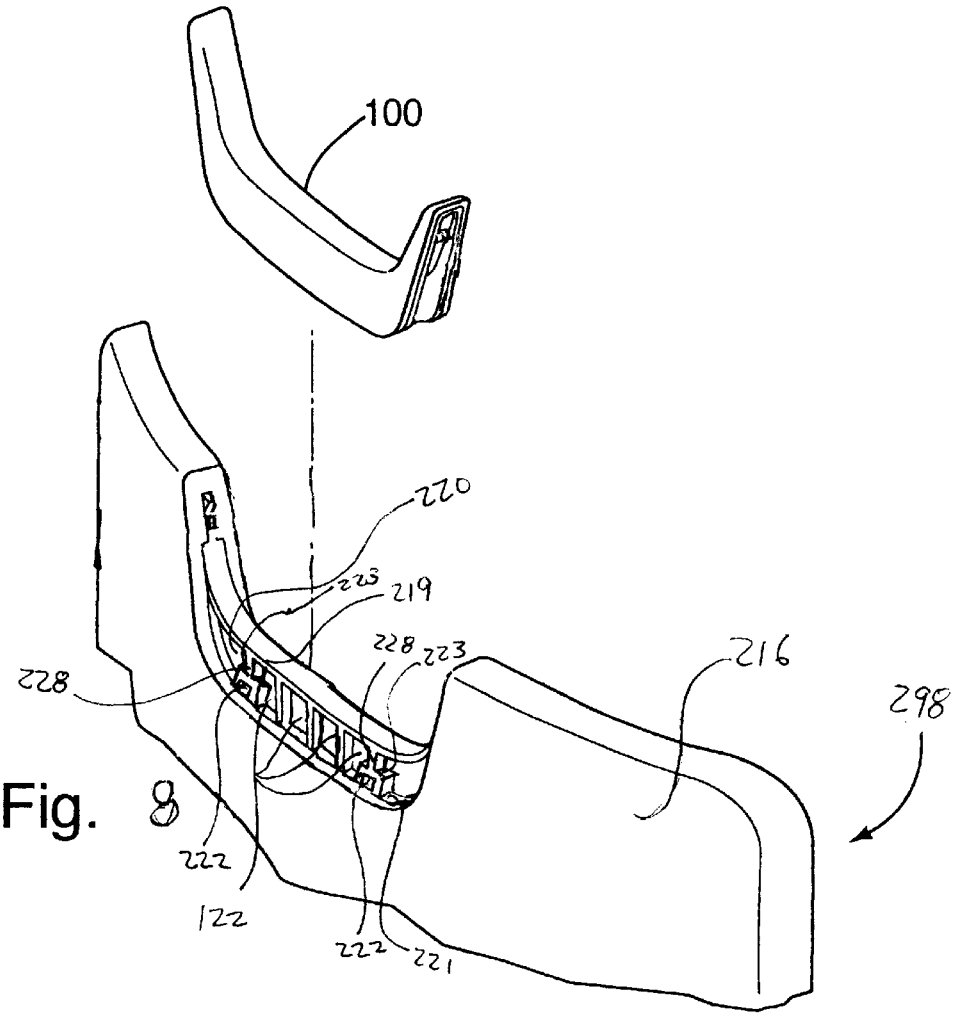
FIG. 8 is an exploded perspective view of an alternative embodiment of the handle and the drawer.
Figure 9:
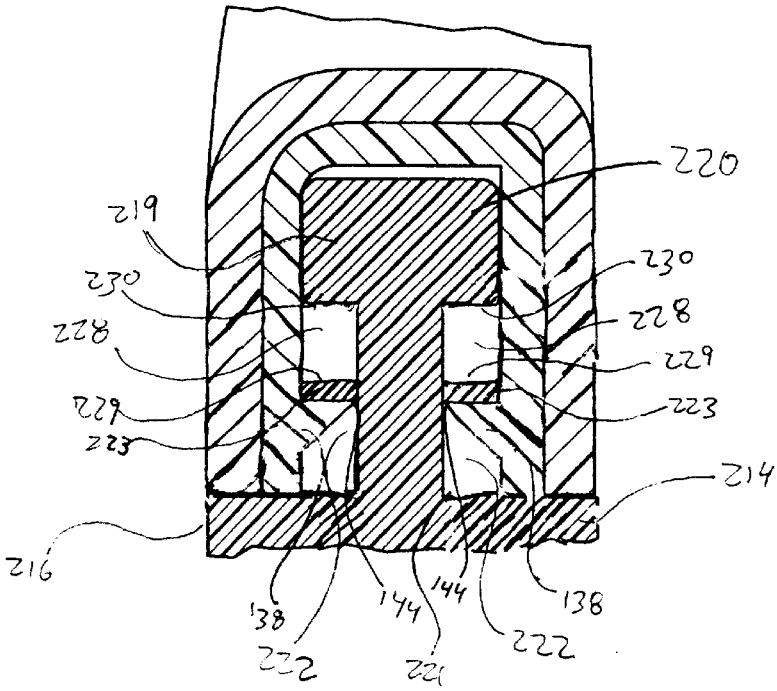
FIG. 9 is a cross-sectional view of the alternative embodiment of the handle secured to the drawer.

In an alternative embodiment of FIGS. 8 and 9, the rib 220 of the front drawer panel 298 further includes a number of locking recesses 222. The rib 220 includes a rim 219 that extends substantially the entire length of the rib 220 so that the rib 220 and the rim 219 form a substantially T-shaped cross-section. Optionally, the rib and rim may form an inverted L-shaped cross section as desired. Locking recesses 222 are spaced along the base 221 of the rib 220, but may be spaced anywhere on the rib as desired. These recesses 222 may be located on the internal panel side 214, the external panel side 216, or both. Any number of recesses 222 may be used as desired. In a preferred embodiment, there are at least two locking recesses 222 located on each of the internal panel side 214 and external panel side 216 of the rib 220. And optionally, the recesses may be apertures defined through the base 221, or other region of the rib 220.

A guide 228 preferably extends from the top 223 of each aperture 222 to the top 225 of the rib 220. Each guide 228 is a straight protrusion from the rib 220 having a first end 229 and a second end 230. The first end 229 of each guide 228 abuts the top 223 of a locking recess 222. The second end 230 of each guide 228 abuts the rim 219. Each guide 228 is substantially continuous with both the top 223 of the respective locking recess 222 and the rim 219 so that a smooth junction exists between the guide 228 and each of the locking recess 222 and rim 219.

As the handle 100 is placed over the rib 220, the tip 144 of each tooth 138 clears the rim 219 and rides along a guide 228. The interaction of the teeth 138 and the guides 228 prevents each tooth 138 from interlocking with a rib recess 122 as the handle 100 is pressed onto the rib 220. As each guide 228 terminates at a locking recess 222, the tip 144 of each tooth 138 passes over the top 223 of the locking recess 222 and interlocks in the locking recess 222. In this interlocked configuration, it is extremely difficult to dislodge the tips 144 of the teeth 138 from the locking recesses 222. As a result, the handle 100 is not easily removed from the rib 220, that is, it is "permanently" secured to the drawer.

If it is necessary to remove the handle 100 from the rib 220, the guides 228 aid in the removal of the handle 100 by preventing the teeth 138 from interlocking with recesses 122 as the handle 100 is removed. Each tip 144, after being dislodged from the corresponding locking recess 222, passes over the top 223 of the locking recess 222 and rides along the guide 228 until the tip 144 clears the rim 219 and the handle 100 is removed from the rib 220.

The above description is that of preferred embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a,""an,""the" or "said" is not to be construed as limiting the element to the singular.

The embodiments of the invention in which an exclusive property or privilege is claimed are defined as follows:

1. A handle for an article comprising:

a substantially rigid substrate having a middle and two ends extending at angles from opposite portions of said middle, said substrate defining a channel extending through said middle and said two ends, said substrate having an interior surface defining said channel and an exterior surface, said substrate further including at least one catch within said channel in each of said ends, said substrate further including at least one tooth within said channel in said middle, said catches and said at least one tooth adapted to secure said substrate to the article; and a supple material forming a gripping surface secured to said outer surface.

2. The handle of claim 1, wherein said substrate is adapted to press-fit over a rib whereby said channel clasps to the rib.

3. The handle of claim 1, wherein said material is attached to said substrate by injection molding.

4. The handle of claim 3, wherein at least one of said material and said substrate is a plastic.

5. The handle of claim 1, wherein two catches project outwardly from said ends of said substrate and four teeth project inwardly from said middle of said substrate inner surface into said channel.

6. A drawer assembly comprising:

a drawer including at least one panel, said panel defining at least one recess having an edge, said edge including a rib and at least one snap spaced from one another; and a handle including a substrate and a grippable material secured to said substrate, said substrate shaped to follow said edge of said recess, said substrate defining a channel throughout its length fitted over said edge of said recess, said substrate having both at least one tooth and at least one catch within said channel, said at least one tooth interlocking with said rib and said at least one catch interlocking with said at least one snap to prevent relative movement between said handle and said drawer.

7. The drawer assembly of claim 6, wherein said rib includes a rim, wherein said rib and said rim form at least one of a substantially T-shaped cross section and a substantially L-shaped cross section.

8. The drawer assembly of claim 6, wherein said rib includes at least one rib recess, wherein said at least one tooth interlocks with said at least one rib recess.

9. The drawer assembly of claim 6, wherein said material is attached to said substrate by injection molding said material onto said substrate.

10. An article of furniture comprising:

a panel having an edge, said panel defining a recess in said edge, said recess including a bottom and two sides extending from said floor to said edge, said bottom including a first snap-fit portion, each of said sides including a second snap-fit portion; and a handle including a relatively rigid body including a third snap-fit portion snap-fitting with said first snap-fit portion on said recess bottom, said body further including fourth snap-fit portions each snap-fitting with one of said second snap-fit portions on each of said recess sides, said handle further including a relatively soft material covering and secured to said body, said soft material providing a gripping surface for said handle.

11. An article of furniture as defined in claim 10 wherein said body defines a channel fitted over said bottom and said sides of said recess.

12. An article of furniture as defined in claim 10 wherein said body portion extends substantially the full extent of said bottom and said sides of said recess.

* * * * *